US006893358B2

(12) United States Patent
Dewanjee et al.

(10) Patent No.: US 6,893,358 B2
(45) **Date of Patent: *May 17, 2005**

(54) PUTTER-TYPE GOLF CLUB HEAD WITH AN INSERT

(75) Inventors: Pijush K. Dewanjee, Carlsbad, CA (US); Herbert Reyes, Laguna Niguel, CA (US); Bart R. Fliers, Vista, CA (US); David B. McGrath, San Marcos, CA (US); Ronald K. Hettinger, Oceanside, CA (US); Wayne H. Byrne, Murrieta, CA (US); John G. Guard, Oceanside, CA (US); Augustin W. Rollinson, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 30 days.

This patent is subject to a terminal disclaimer.

(21) Appl. No.: 10/604,312

(22) Filed: Jul. 10, 2003

(65) Prior Publication Data

US 2004/0106465 A1 Jun. 3, 2004

Related U.S. Application Data

(60) Continuation-in-part of application No. 09/693,349, filed on Oct. 20, 2000, now Pat. No. 6,632,391, which is a division of application No. 09/389,798, filed on Sep. 3, 1999, now Pat. No. 6,238,302.

(51) Int. Cl.[7] ..... A63B 53/04

(52) U.S. Cl. ..... 473/340; 473/342; 473/349

(58) Field of Search ..... 473/324–350, 473/313

(56) References Cited

U.S. PATENT DOCUMENTS

| | | | | |
|---|---|---|---|---|
| 3,937,474 A | | 2/1976 | Jepson et al. | |
| 5,029,865 A | * | 7/1991 | Kim | 473/330 |
| 5,207,427 A | * | 5/1993 | Saeki | 473/343 |
| 5,303,922 A | | 4/1994 | Lo | |
| 5,405,137 A | | 4/1995 | Vincent et al. | |
| 5,458,332 A | | 10/1995 | Fisher | |
| 5,485,997 A | | 1/1996 | Schmidt et al. | |
| 5,489,098 A | * | 2/1996 | Gojny et al. | 473/342 |
| 5,524,331 A | | 6/1996 | Pond | |
| 5,575,472 A | | 11/1996 | Magerman et al. | |
| 5,674,132 A | * | 10/1997 | Fisher | 473/290 |
| 5,713,800 A | * | 2/1998 | Su | 473/342 |
| 5,743,813 A | | 4/1998 | Chen et al. | |
| 5,924,939 A | | 7/1999 | Grace et al. | |
| 5,931,743 A | | 8/1999 | Baker et al. | |
| 6,093,116 A | * | 7/2000 | Hettinger et al. | 473/332 |
| 6,224,496 B1 | | 5/2001 | Rowland et al. | |
| 6,238,302 B1 | * | 5/2001 | Helmstetter et al. | 473/340 |

* cited by examiner

*Primary Examiner*—Sebastiano Passaniti
(74) *Attorney, Agent, or Firm*—Michael A. Gatania; Elaine H. Lo

(57) ABSTRACT

A method for manufacturing a golf club head with a thermoplastic polyurethane insert is disclosed herein. The thermoplastic polyurethane insert is disposed in a recess of the club head in which the recess has a depth that is greater than the thickness of the insert. The thermoplastic polyurethane insert has a plurality of tabs on its perimeter to engage the recess walls to allow the insert to essentially float within the recess. An adhesive is disposed between the rear wall of the recess and an interior surface of the insert. Further, an adhesive is applied between the plurality of tabs, and preferably over the exterior surface of each of the plurality of tabs.

10 Claims, 14 Drawing Sheets

FIG. 3
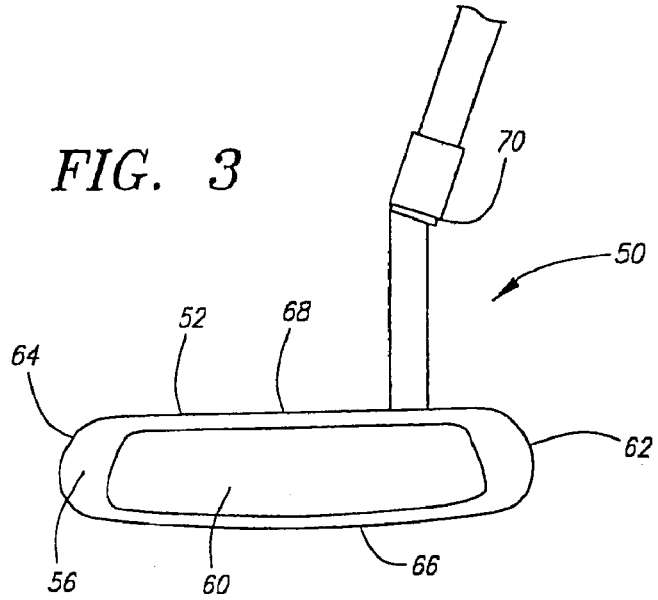
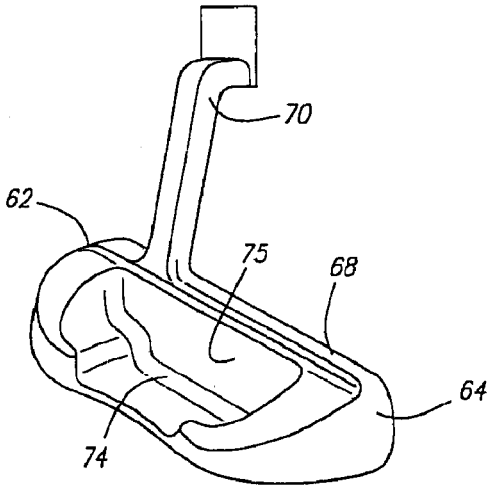
FIG. 3A
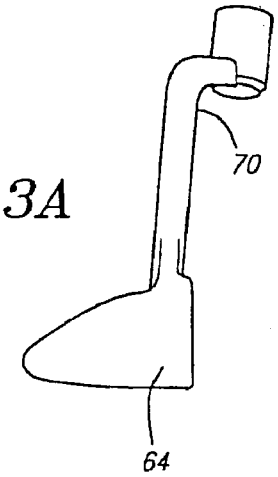
FIG. 3B
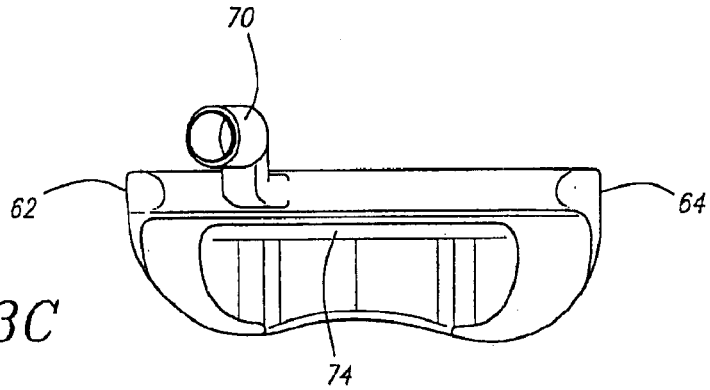
FIG. 3C

FIG. 5
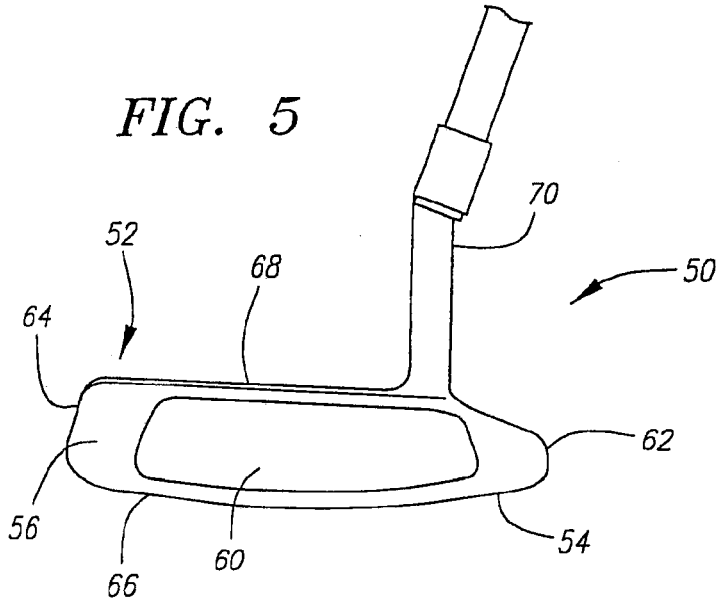
FIG. 5B
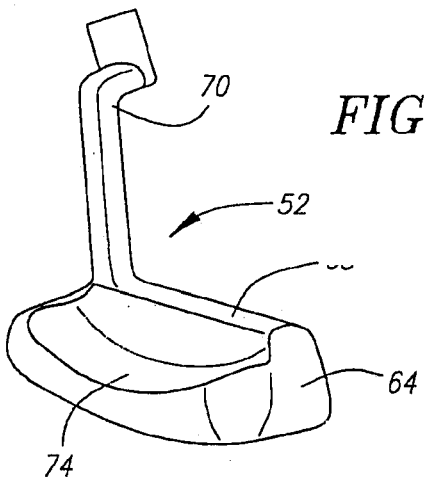
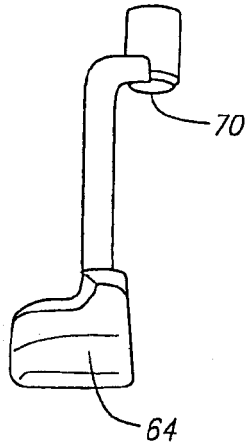
FIG. 5A
FIG. 5C
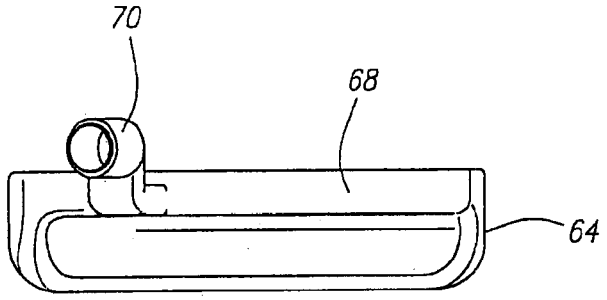

PUTTER-TYPE GOLF CLUB HEAD WITH AN INSERT

CROSS REFERENCE TO RELATED APPLICATIONS

This application is a continuation-in-part application of U.S. patent application Ser. No. 09/693,349,filed on Oct. 20, 2000, now U.S. Pat. No. 6,632,391, which is a divisional application of U.S. patent application Ser. No. 09/389,798, filed on Sep. 3, 1999, now U.S. Pat. No. 6,238,302, issued May 29, 2001.

FEDERAL RESEARCH STATEMENT

[Not Applicable]

BACKGROUND OF INVENTION

1. Field of the Invention

The present invention relates to a golf club head with an insert. More specifically, the present invention relates to a putter head with a polymer insert having integral tabs for placement within a recess of the club head.

2. Description of the Related Art

Throughout the history of golf, which dates back to as early as 1457, various techniques have been used to enhance the hitting characteristics of golf club heads. Golf club heads having inserts for the striking portion have been used at least as far back as 1880's when leather face irons were manufactured in Scotland. Golfers in the 1890's were able to purchase putters with faces composed of gutta percha. More recently, inserts composed of various materials and shapes have been put forth by the creative geniuses of the golf industry to provide golfers with better feel and control of the golf ball.

One example is an ODYSSEY® putter having a STRONOMIC® insert that is disclosed in Magerman et al., U.S. Pat. No. 5,575,472 for a Golf Putter Head Having Face Insert And Method Of Forming The Same. The Magerman et al. Patent discloses a putter head with a recess into which is poured or inserted a resinous material which cures and is subsequently milled to produce the putter.

Another example is Pond, U.S. Pat. No. 5,524,331 for a Method For Manufacturing Golf Club Head With Integral Inserts that discloses a method for casting a graphite-epoxy composite insert within a recess of a face of a metal club head. The golf club head of the Pond Patent is directed at displacing the weight away from the center and increasing the moment of inertia.

Another example is Schmidt et al., U.S. Pat. No. 5,485,997, for a Golf Putter Head With Face Plate Insert Having Heightened Medial Portion, that discloses a putter head with a face plate composed of a non-metallic material such as an elastomer. The overall construction of the putter head of the Schmidt et al. Patent is directed at enlarging the sweet spot and improving the peripheral weighting.

Yet another example is found in Baker et al., U.S. Pat. No. 5,931,743 for a Putter Having Club Head With A Golf-Ball Engagement Insert And A Shaft Rearwardly Of The Insert which discloses a putter with a center shaft and an insert composed of a thermoplastic polyurethane. Another example is Jepson et al., U.S. Pat. No. 3,937,474 for a Golf Club With Polyurethane Insert, which discloses a wood having an insert on its striking face that is composed of a polyurethane formed from a tolylene diisocyanate polyether terminated prepolymer and a curing agent. The hardness of this insert varies from 40 to 75 shore D, and a Bashore Resiliometer of 17 or above. The polyurethane insert is claimed to impart additional energy to the golf ball during a golf hit.

Chen et al., U.S. Pat. No. 5,743,813 for a Golf Club Head discloses a wood composed of stainless steel with a three layer face having a first stainless steel layer, an elastic layer and a second stainless steel layer. The three-layer face does not absorb the hitting force when a golf ball is hit.

Fisher, U.S. Pat. No. 5,458,332, for a Golf Putter Head With A Cushioning Face, discloses a set of golf putters, each having an insert composed of polyurethane with a hardness in the range of 70 Shore A to about 80 Shore D. The rebound factor of each of the inserts is in the range of 12.5% to 50%, and the inserts are formulated to effect a reproducible direct linear relationship between the rebound factor and the distance of the putt.

Yet another example is McGeeney et al, European Patent Application Number 0891790 for a Multiple Density Golf Club Head And Method Of Manufacturing which discloses a putter with a central segment composed of a thermoplastic elastomer or a thermoset polymer. Possible thermoplastic elastomers include styrene co-polymers, co-polyesters, polyurethanes, polyamides, olefins and vulcanates. Possible thermoset polymers include epoxides, polyimides and polyester resins. The central segment has a minimum durometer hardness of Shore D 50. The central segment is bounded by metallic heel and to portions. However, the use of inserts is restrained in order to maintain the integrity of the game of golf.

In this regard, the Rules of Golf, established and interpreted by the United States Golf Association ("USGA") and The Royal and Ancient Golf Club of Saint Andrews, sets forth certain requirements for a golf club head. The requirements for a golf club head are found in Rule 4 and appendix II. A complete description of the Rules of Golf are available on the USGA web page at www.usga.org. Although the Rules of Golf do not expressly state specific parameters for an insert for a putter, the Rules of Golf have been interpreted to establish that an insert for a putter should have a Shore A hardness greater than 87±2%, have a constant thickness, have a thickness of at least 0.125 inches, and not act like a spring.

The prior art is absent a golf club head that has an insert composed of a material that is soft, but above the USGA requirements, and has a sufficient Bayshore rebound to provide a golf ball with the necessary distance to reach the hole. Further, the prior art has failed to provide an insert that may easily attach to the club head body.

SUMMARY OF INVENTION

One aspect of the present invention is a golf club head including a club head body and a an insert. The club head body has a front face with a recess therein. The insert is disposed within the recess. The insert includes a body with an exterior surface, an interior surface and a perimeter defining the thickness of the body. The insert is composed of a thermoplastic polyurethane material. The perimeter has a plurality of integral tabs extending therefrom that engage the club head body.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF DRAWINGS

FIG. 3 is a front view of another embodiment of the golf club head of the present invention with an insert in the recess of the club head body.

FIG. 3A is a side view of the club head of FIG. 3.

FIG. 3B is a rear view of the club head of FIG. 3.

FIG. 3C is a top view of the club head of FIG. 3.

FIG. 5 is a front view of another embodiment of the golf club head of the present invention with an insert in the recess of the club head body.

FIG. 5A is a side view of the club head of FIG. 5.

FIG. 5B is a rear view of the club head of FIG. 5.

FIG. 5C is a top view of the club head of FIG. 5.

DETAILED DESCRIPTION

Figure 1:
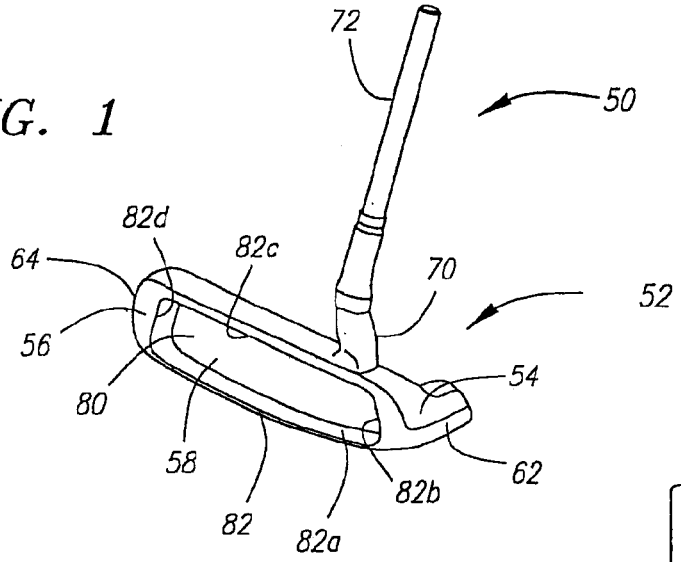
FIG. 1 is a perspective view of one embodiment of the golf club head of the present invention without an insert in the recess of the club head body.
Figure 1B:
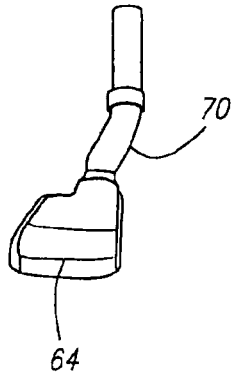
FIG. 1B is a side view of the club head of FIG. 1.
Figure 1A:
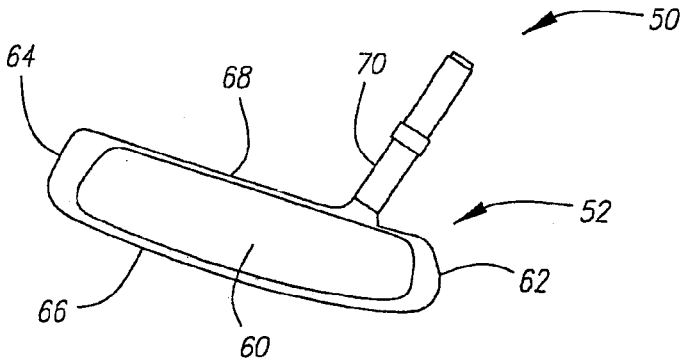
FIG. 1A is a front view of the club head of FIG. 1 with the insert placed therein.
Figure 1D:
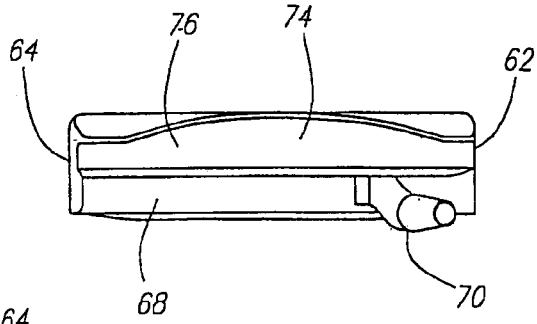
FIG. 1D is a top view of the club head of FIG. 1.
Figure 1C:
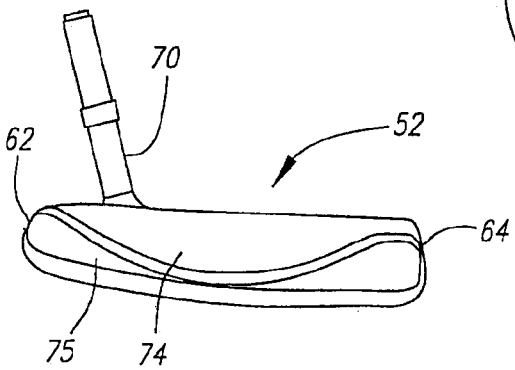
FIG. 1C is a rear view of the club head of FIG. 1.

As shown in FIGS. 1 through 1D, a putter of the present invention is generally designated 50. The putter 50 includes a club head 52 having a body 54 with a front face 56 with a recess 58 therein. The club head 52 of the present invention also includes an insert 60 disposed within the recess 56. The insert 60 extends along most of the face 56 from a heel 62 of the club head 52 to a toe 64 of the club head 52, and from a sole 66 of the club head 52 to a crown 68 of the club head 52. The club head 52 also has a hosel 70 for connection to a shaft 72. Opposite of the front face 56 of the club head 52 is a rear 74 of the club head 52.

The body 54 of the club head 52 is preferably composed of a metallic material such as stainless steel. Other metallic materials include titanium, aluminum, tungsten, zinc, magnesium, and alloys of stainless steel and tungsten. However, those skilled in the pertinent art will recognize that the body 54 may be composed of other materials without departing from the scope and spirit of the present invention. Further, the non-insert portion of the face 56 may be smooth or textured to provide a consistent or non-consistent surface with the exterior surface of the insert. Additionally, the body 54 may be specifically weighted to provide a specific center of gravity and inertial properties for the putter 50.

FIGS. 2–6C illustrate various embodiments of putters 50 of the present invention. Each of the putters 50 of FIGS. 2–6C has a club head 52 with a body 54 and an insert 60 disposed within a recess 58 of the body 54. The putters 50 illustrated in FIGS. 1–6C are flanged blade, mallet and semi-mallet putters, however, those skilled in the art will recognize that other similar putter designs may be utilized without departing from the scope and spirit of the present invention. In a preferred embodiment, each of the club heads 52 weigh approximately 328 grams ±7 grams. Further, in a preferred embodiment, the recess 58 of each of the club heads 52 has a depth of approximately 0.205 inches ±0.010 inches.

Referring specifically to FIG. 1, the recess 58 of the body 54 is defined by a recess face wall 80 which is substantially parallel with the insert 60, and a recess edge wall 82 which is substantially perpendicular to the recess face wall 80. The recess face wall 80 defines the depth of the recess 58 that will determine the thickness of the polymer insert 60. The recess edge wall 82, as shown in FIG. 1, is composed of a bottom recess edge wall 82*a*, a heel recess edge wall 82*b*, a top recess edge wall 82*c* and a toe recess edge wall 82*d*. The recess edge wall 82 defines the shape of the recess 58, and the length of the recess edge wall 82 is determined by the depth of the recess 58. In a preferred embodiment, the insert 60 will engage the recess edge wall 82 as described below.

The putter 50 of FIGS. 1–1D is a flanged blade style putter. The rear 74 of the club head 52 has a rear wall 75 and a flanged portion 77. The insert 60 of this embodiment occupies approximately 67.90% of the face area of the club head 52. The insert 60 also occupies approximately 20.71% of the volume of the club head 52. Yet further, the insert 60 of this embodiment is approximately 3.95% of the weight of the club head 52.

Figure 2:
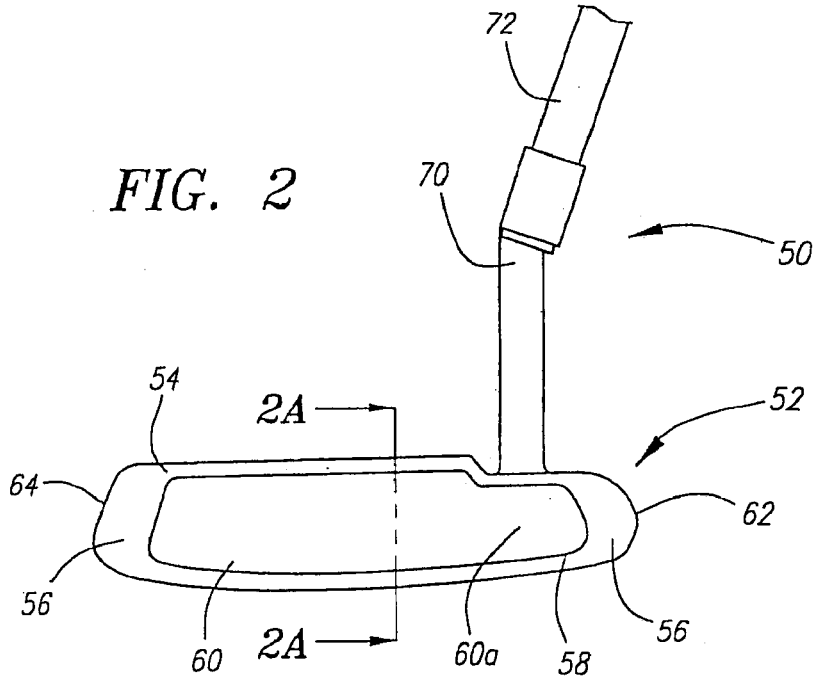
FIG. 2 is a front view of another embodiment of the golf club head of the present invention with an insert in the recess of the club head body.
Figure 2B:
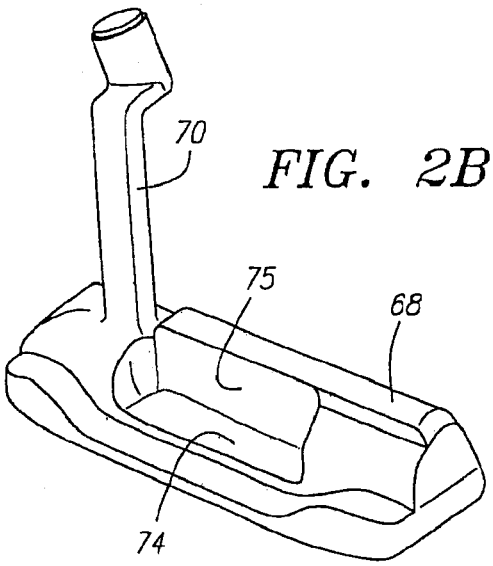
FIG. 2B is a rear view of the club head of FIG. 2.
Figure 2A:
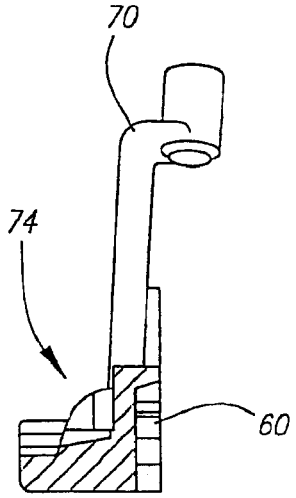
FIG. 2A is a partial cross-sectional side view of the club head of FIG. 2.
Figure 2C:
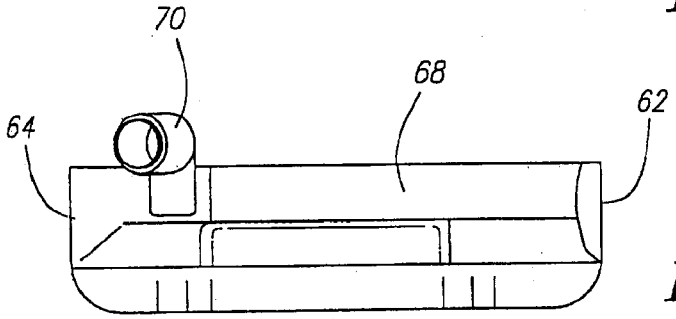
FIG. 2C is a top view of the club head of FIG. 2.

The putter 50 of FIGS. 2–2C is also a blade style putter, however, it has an offset hosel 70, and an insert 60 with a panhandle portion 60*a*. The insert 60 is one-piece, including the panhandle portion 60*a*. It is apparent from FIG. 2 that this putter 50 has a larger area of the non-insert portion of the face 56 than the embodiment shown in FIG. 1A. The insert 60 of this embodiment occupies approximately 69.22% of the face area of the club head 52. The insert 60 also occupies approximately 20.33% of the volume of the club head 52. Yet further, the insert 60 of this embodiment is approximately 3.86% of the weight of the club head 52.

The putter 50 of FIGS. 3–3C is a half-mallet style putter with an offset hosel 70. The insert 60 has a trapezoidal shape with parallel sides and a curved bottom portion. It is apparent from FIG. 3 that the toe end and heel end of the face 56 of this putter 50 has a large area of the non-insert portion. The insert 60 of this embodiment occupies approximately 68.27% of the face area of the club head 52. The insert 60 also occupies approximately 17.15% of the volume of the club head 52. Yet further, the insert 60 of this embodiment is approximately 3.08% of the weight of the club head 52.

Figure 4:
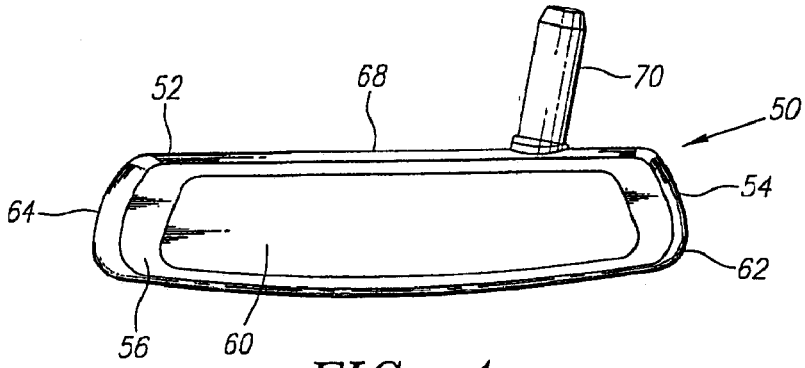
FIG. 4 is a front view of another embodiment of the golf club head of the present invention with an insert in the recess of the club head body.
Figure 4A:
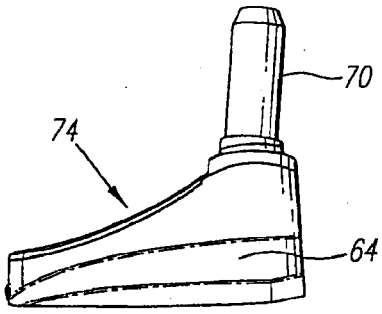
FIG. 4A is a side view of the club head of FIG. 4.
Figure 4B:
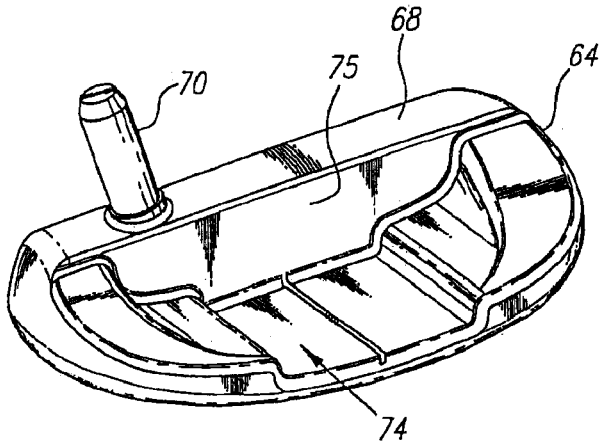
FIG. 4B is a rear view of the club head of FIG. 4.
Figure 4C:
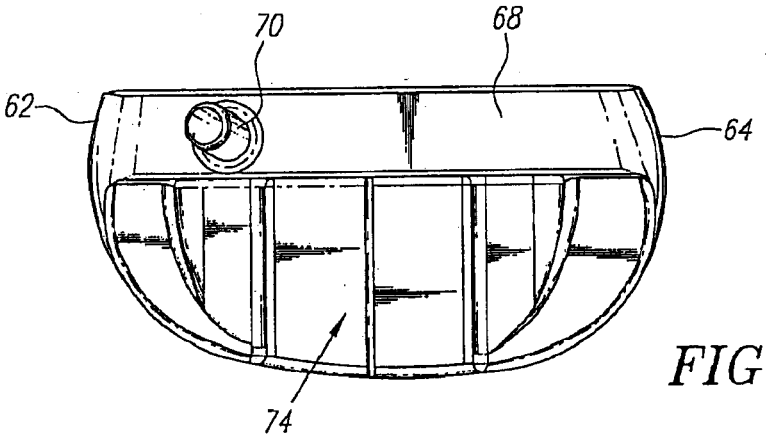
FIG. 4C is a top view of the club head of FIG. 4.

The putter of FIGS. 4–4C is a mallet style putter, however, it does not have an offset hosel 70. The insert 60 of this embodiment occupies the largest amount of the face area of the club head 52, approximately 70.38%. However, the insert 60 occupies the smallest volume of the club head 52, approximately 16.24%. Yet further, the insert 60 of this embodiment is the lightest, weighing approximately 2.46% of the club head 52.

Figure 6:
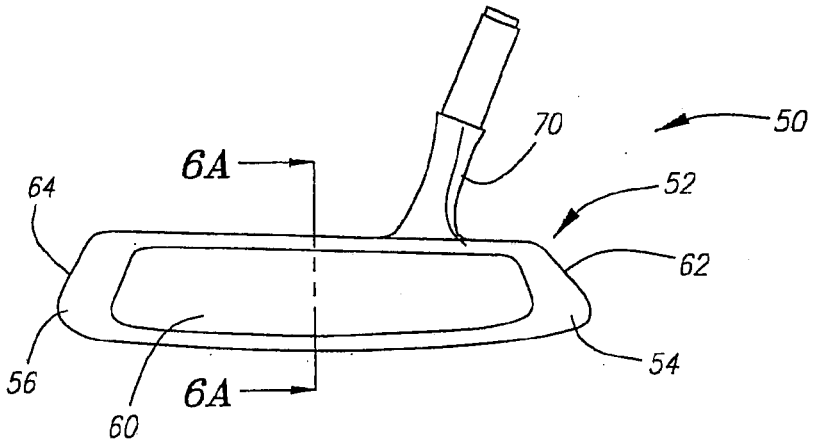
FIG. 6 is a front view of another embodiment of the golf club head of the present invention with an insert in the recess of the club head body.
Figure 6B:
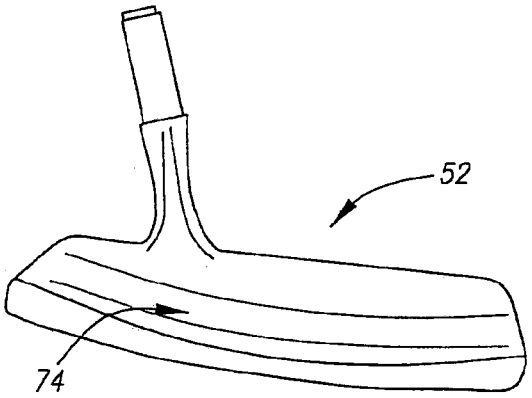
FIG. 6B is a rear view of the club head of FIG. 6.
Figure 6A:
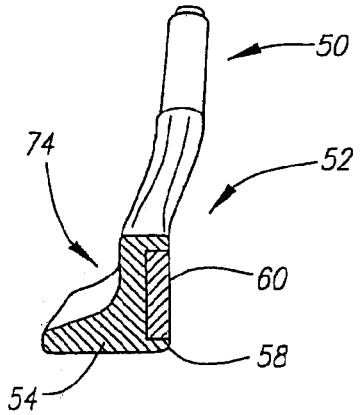
FIG. 6A is a partial cross-sectional side view of the club head of FIG. 6.
Figure 6C:
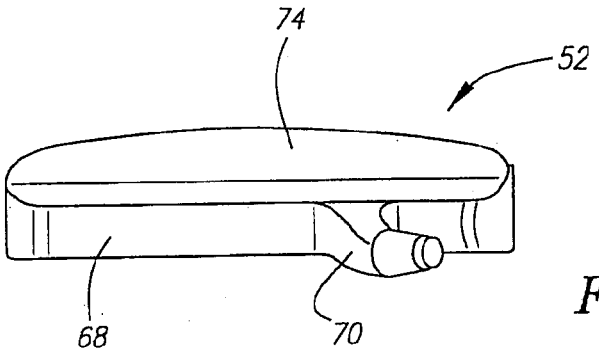
FIG. 6C is a top view of the club head of FIG. 6.

The putter 50 of FIGS. 5–5C is a flanged-blade style putter with an offset hosel 70. The insert 60 has a trapezoidal shape with parallel sides and a curved bottom portion. It is apparent from FIG. 5 that the toe end and heel end of the face 56 of this putter 50 has a non-insert portion larger than any of the other embodiments. The insert 60 of this embodiment only occupies approximately 59.82% of the face area of the club head 52. The insert 60 also occupies approximately 18.43% of the volume of the club head 52. Yet further, the insert 60 of this embodiment is approximately 3.42% of the weight of the club head 52. The putter of FIGS. 6–6C is a blade style putter. As shown in FIG. 6A, the polymer 60 only occupies a small portion of the volume of the club head 52 compared to the body 54 of the club head 52.

The inserts 60 of FIGS. 1–6C vary in shape and thickness depending on the design of the putter 50. A preferred shape of the insert 60 is a trapezoidal shape with curved corners. An alternative shape is a trapezoidal shape with a panhandle as illustrated in FIG. 2. The weight of the insert 60 may be adjusted, and may vary in a range of 1.0%–5% of the weight of the club head 52. Further, the volume of the insert 60 may vary between 10% and 25% of the volume of the club head 52. Additionally, the percentage of the face area occupied by the insert 60 may vary between 55% and 75% of the total area of the face 56.

Figure 7:
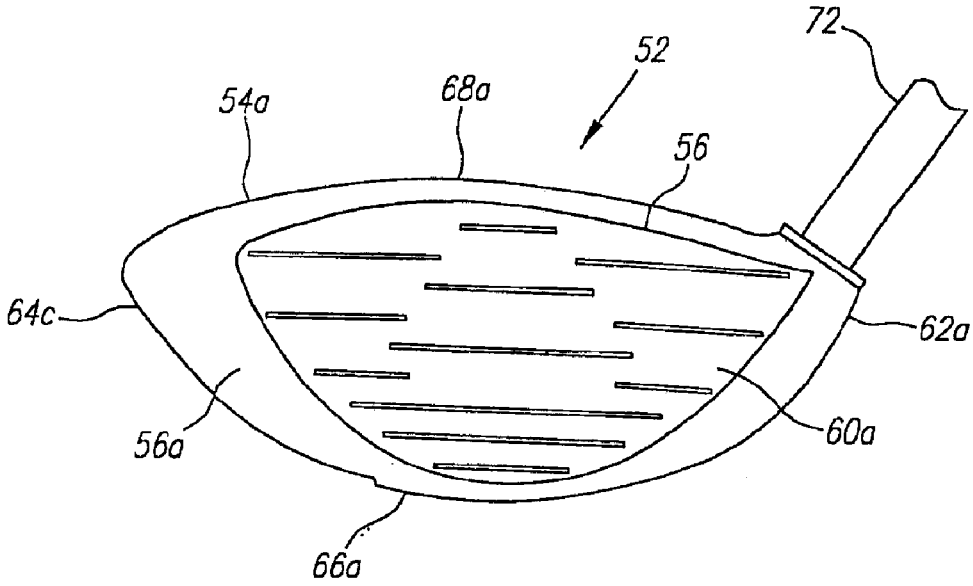
FIG. 7 is a front view of a wood club head with an insert of the present invention.
Figure 8:
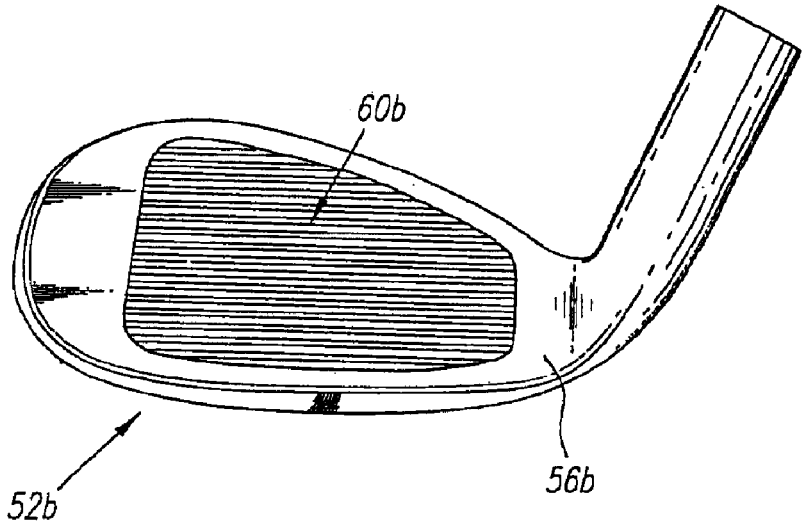
FIG. 8 is a front view of an iron club head with an insert of the present invention.

FIG. 7 illustrates yet another utilization of the insert 60*a* in a wood club head 52*a*. The insert 60*a* occupies most of the face 56*a*, from the heel 62*a* to the toe 64*a*, and from the sole 66*a* to the crown 68*a*. The body 54*a* of the club head 52*a* may be hollow, unlike the putters 50 of the previous embodiments. Further, the recess face wall, not shown, of the recess 58*a* will not abut the rear wall, not shown, unlike the putters 50 of the previous embodiments. The body 54*a* may be composed of titanium, or steel. FIG. 8 illustrates a further embodiment where the insert 60*b* is used on the face 56*b* of an iron club head 52*b*.

Figure 9:
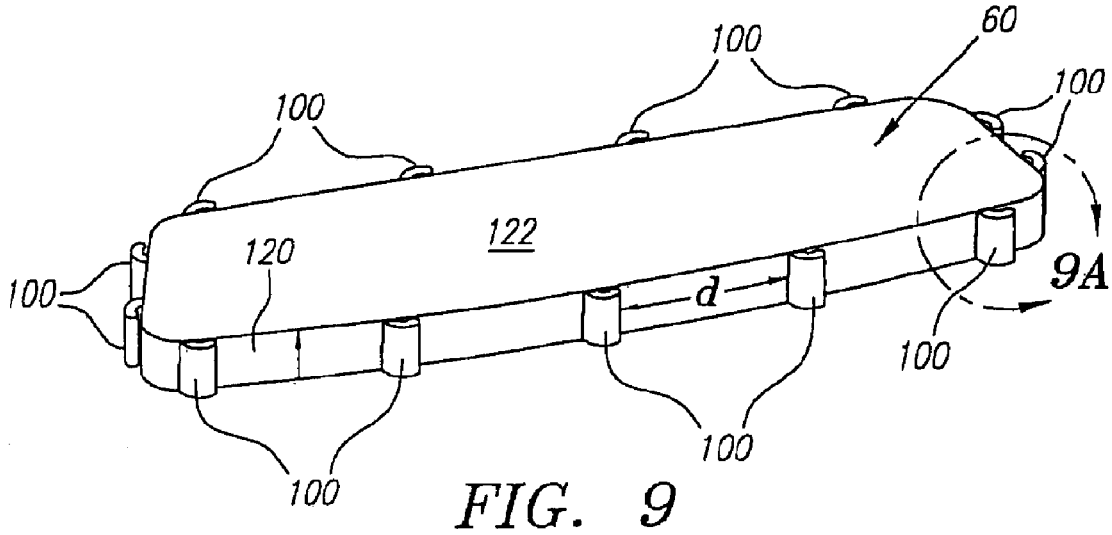
FIG. 9 is an isolated perspective view of one embodiment of the insert of the present invention.
Figure 9A:
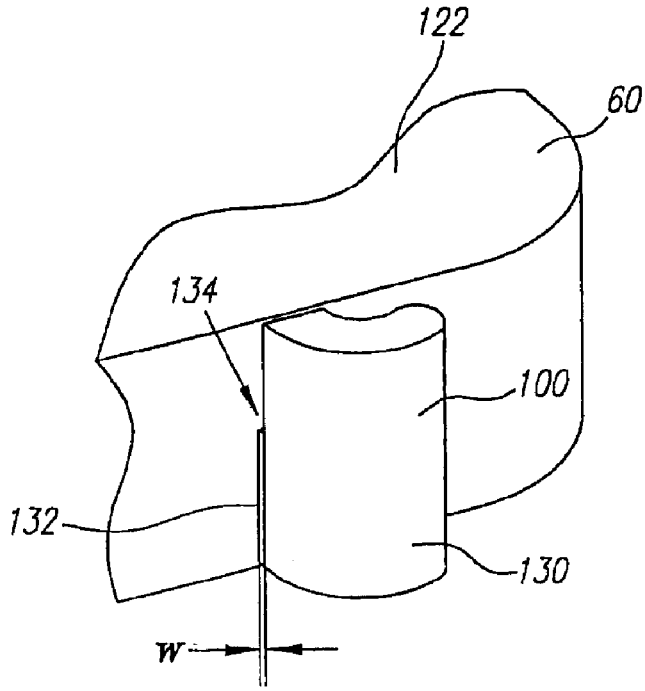
FIG. 9A is an enlarged view of circle A of FIG. 9.
Figure 10:
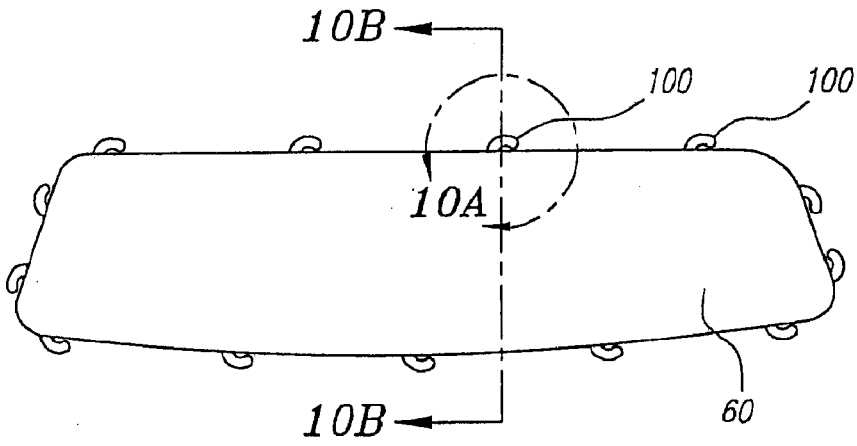
FIG. 10 is a front view of the insert of FIG. 9.
Figure 10A:
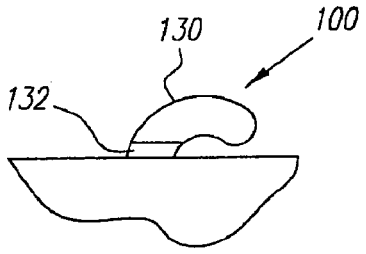
FIG. 10A is an enlarged view of circle A of FIG. 10.
Figure 10B:
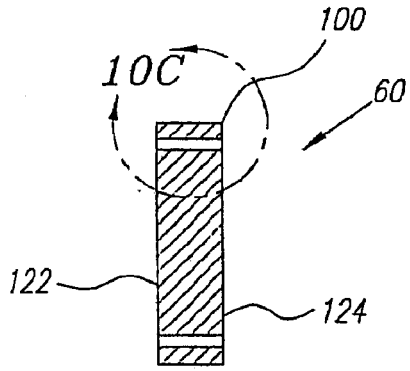
FIG. 10B is a cross-sectional view of the insert of FIG. 10 along lines B—B.
Figure 10C:
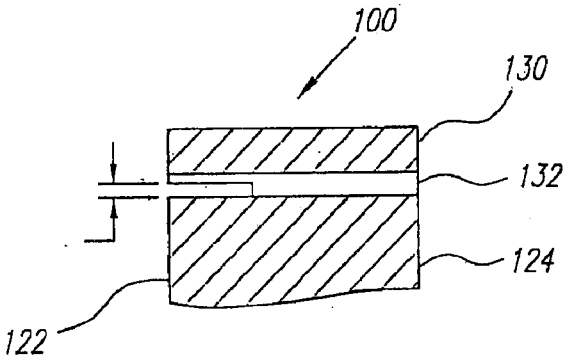
FIG. 10C is an enlarged view of circle C of FIG. 10B.

FIGS. 9–10C illustrate isolated views of one embodiment of the insert 60 of the present invention. The insert 60 has a plurality of tabs 100 spaced substantially equidistant apart. In a preferred embodiment, the distance "d" is 0.41 inches. However, those skilled in the pertinent art will recognize that the value of d may be adjusted for various embodiments. The plurality of tabs 100 lie on a perimeter 120 of the insert 60. The perimeter defines the thickness of the insert 60. A preferred thickness is 0.198 inches, however the thickness may preferably range from 0.125 to 0.50 inches. The insert 60 has an interior surface 124 and an exterior surface 122. The interior surface 124 faces the recess face wall 80 while the exterior surface 122 forms a portion of the face 56 of the club head 52.

In a preferred embodiment, each of the plurality of tabs 100 is composed of a curved portion 130 and a straight portion 132. The straight portion 132 projects from the perimeter 120 and becomes the curved portion 130. The curved portion 132 engages with the recess edge wall 82 of the recess 58 of the club head 52. An undercut 134 is formed between the curved portion 130 and the perimeter 120 on the exterior surface 122 side of the insert 60. The undercut 134 is cut from the straight portion 132 thereby creating a straight portion 132 that does not extend along the entire width of the perimeter 120. Further, the curved portion 130 does not extend along the entire width of the perimeter 120, terminating just prior to the exterior surface 122. However, the curved portion 130 does extend further than the straight portion 132. The height "h" of the undercut 134 is preferably 0.01 inches, however it may range from 0.005 inches to 0.025 inches. Each of the plurality of tabs 100 is compressible for engagement of the insert 60 into the recess 58 of the club head 52. As described below, an adhesive is filled between the tabs 100 and into the undercuts 134 when the insert 60 is mounted in the recess 58 of the club head 52.

Figure 11:
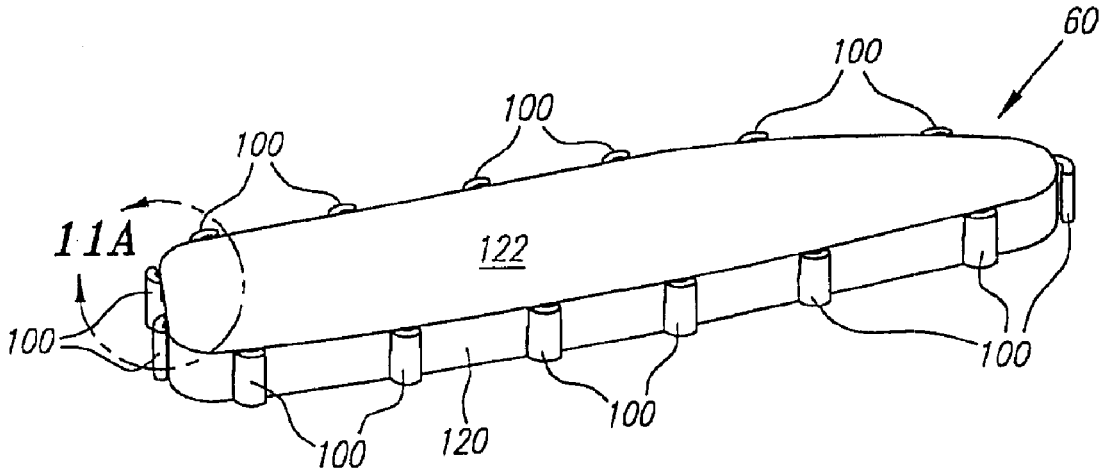
FIG. 11 is an isolated perspective view of an alternative embodiment of the insert of the present invention.
Figure 11A:
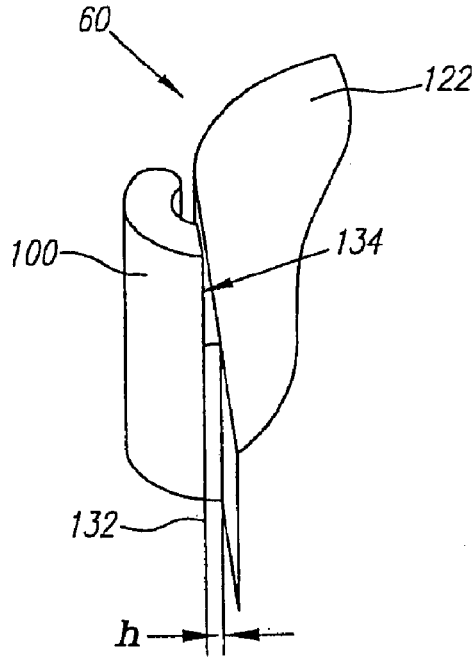
FIG. 11A is an enlarged view of circle A of FIG. 11.
Figure 12:
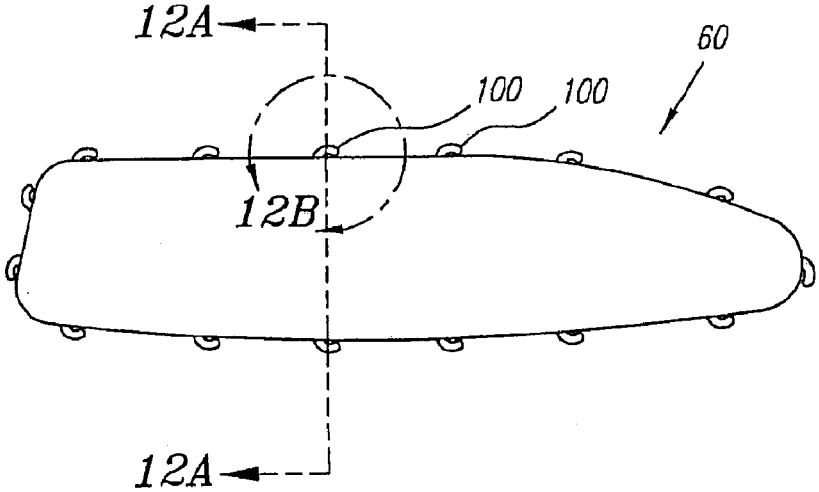
FIG. 12 is a front view of the insert of FIG. 11.
Figure 12B:
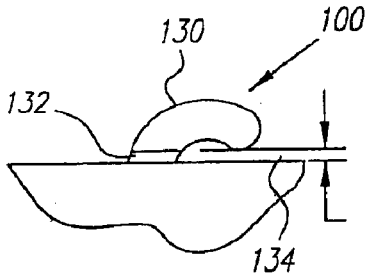
FIG. 12B is an enlarged view of circle B of FIG. 12.
Figure 12A:
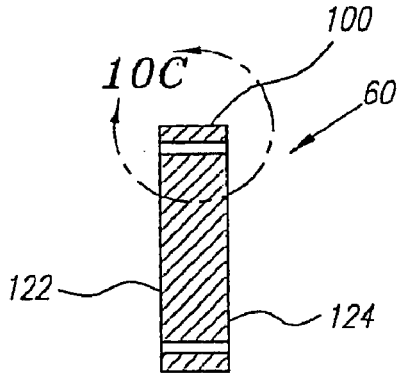
FIG. 12A is a cross-sectional view of the insert of FIG. 12 along lines A—A.
Figure 12C:
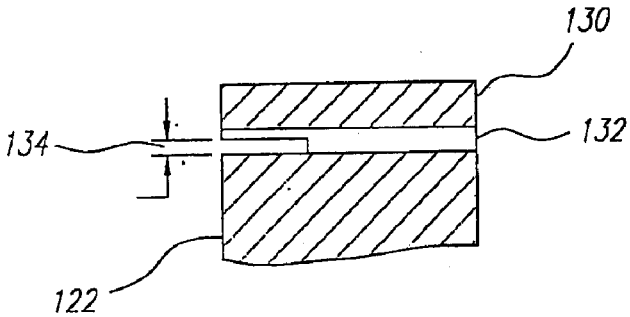
FIG. 12C is an enlarged view of circle C of FIG. 12A.

FIGS. 11–12C illustrate isolated views of a different embodiment of the insert of the present invention. The insert 60 of FIGS. 11–12C has different shape than the insert 60 of FIGS. 9–10C.

Figure 13:
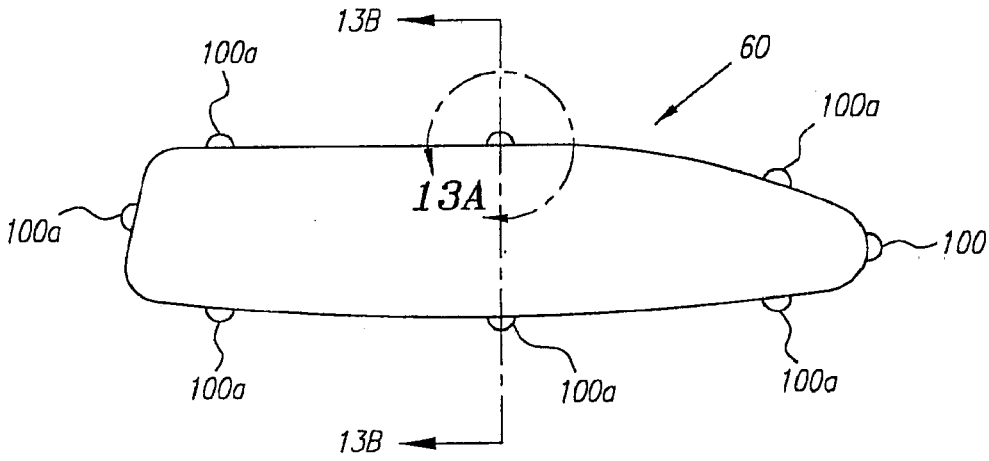
FIG. 13 is a front view of an alternative embodiment of the insert of the present invention.
Figure 13A:
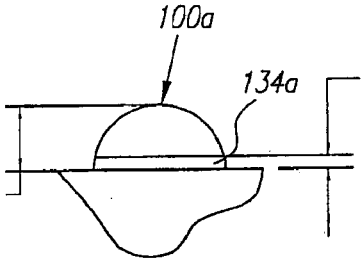
FIG. 13A is an enlarged view of circle A of FIG. 13.
Figure 13B:
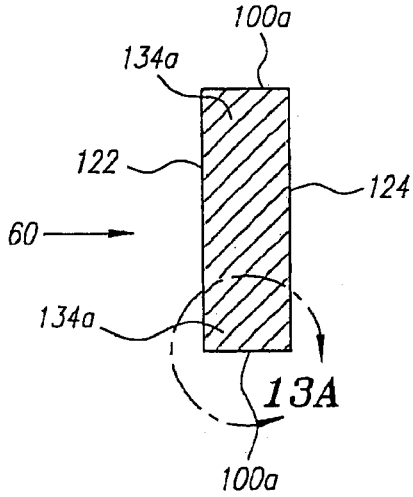
FIG. 13B is a cross-sectional view of the insert of FIG. 13 along lines B—B.
Figure 13C:
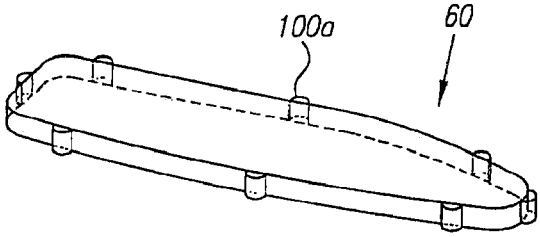
FIG. 13C is a perspective view of the insert of FIG. 13.

FIGS. 13–13C illustrate yet another embodiment of the insert 60 of the present invention. In this embodiment, each of the plurality of tabs 100*a* has a hemispherical shape with an undercut 134*a* on the exterior surface 122 side of the insert 60.

Figure 14:
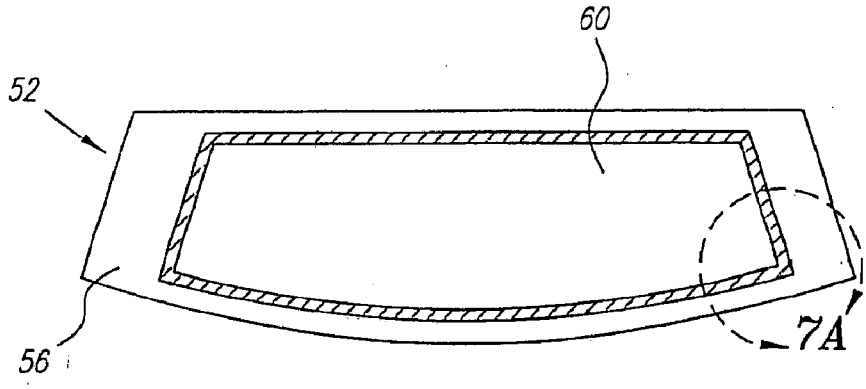
FIG. 14 is an isolated front view of an insert disposed within a recess of the face of a golf club head of the present invention.
Figure 14A:
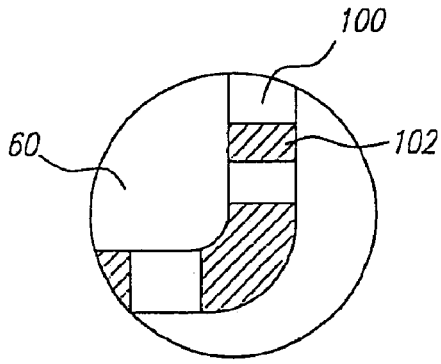
FIG. 14A is an enlarged view of the circle A of FIG. 14.
Figure 14B:
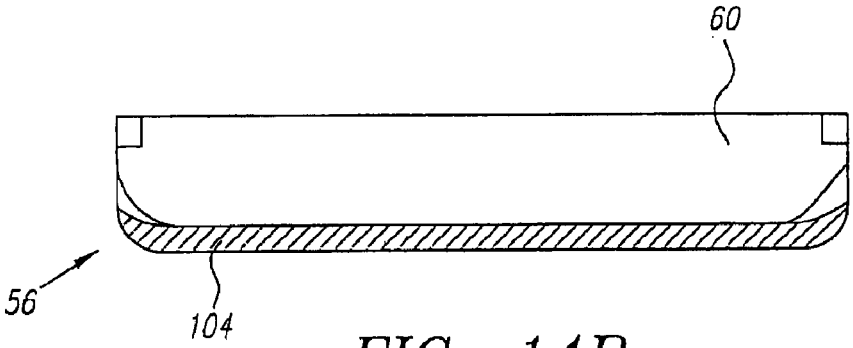
FIG. 14B is an isolated view of the insert within the recess of the club head, and bonded to the recess wall by an epoxy.
Figure 15:
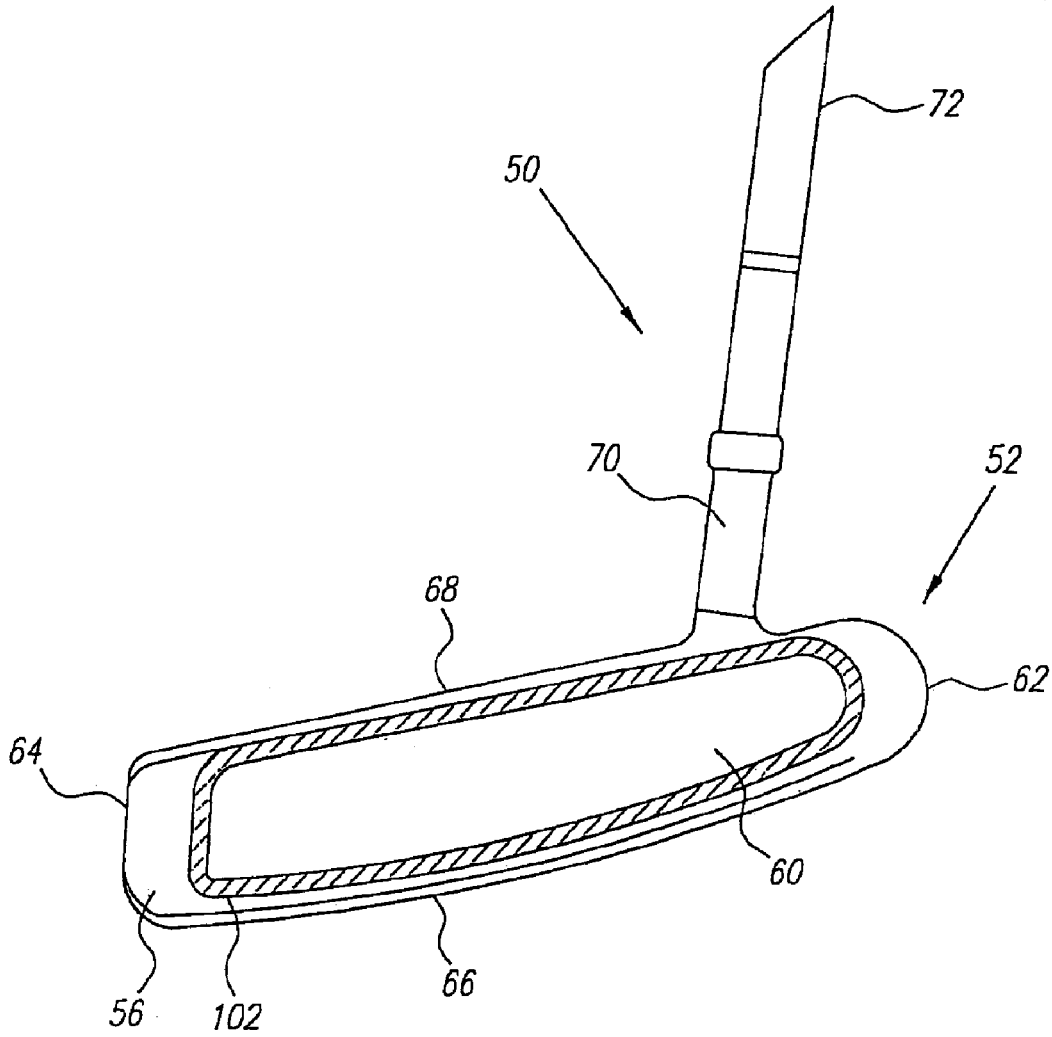
FIG. 15 is a front view of a putter of the present invention.

FIGS. 14–14B illustrate the attachment of the polymer insert 60 to the club head 54. The plurality of tabs 100 hold the insert in place, allowing it to "float" while the adhesive cures. The plurality of tabs 100 allow for precise depth placement of the insert within the recess. Such precision is not available in the prior art. Further, the ability of the insert 60 to "float" due to the plurality of tabs 100 also eliminates a tooling step in the manufacture of the club head of the present invention. As shown in FIGS. 14–14B, the polymer insert 60 is held within the recess 58 by the tabs 100 on the perimeter of the insert 100, an adhesive 102 applied into the spacings between the tabs 100, and an adhesive 104 applied to the recess frontal wall 80 and/or the interior surface 124 of the insert 60. In a preferred embodiment illustrated in FIG. 15, the adhesive 102 is applied along the entire perimeter 120, not shown, of the insert 60 thereby covering each of the plurality of tabs 100. A preferred adhesive is DP460 epoxy adhesive from 3M of Minneapolis, Minn. Other possible epoxies are JET WELD® urethane epoxy, and DP270, both available from 3M. Other adhesives may be utilized in practicing the present invention, however, the thermal coefficient of the adhesive should be applicable to manufacturing, distributing and playing temperatures of club heads.

In a preferred embodiment, the insert 60 is composed of a thermoplastic polyurethane material, preferably an injection moldable thermoplastic polyurethane. Such thermoplastic polyurethanes include 4.4'-diphenylmethane diisocyanate-polyester thermoplastic polyurethanes available from BAYER under the brand name TEXIN 250 or TEXIN 255, apara-phenylene diisocyanate-polyether thermoplastic polyurethane available from DUPONT CHEMICALS under the brand name HYLENE, and a 4.4'-diphenylmethane diisocyanate-polyester thermoplastic polyurethane available from HUNTSMAN CHEMICAL under the brand name IROGRAN 433.63.

The Shore D hardness of the thermoplastic polyurethane material for the insert 60 preferably ranges from 40 to 70 Shore D, more preferably from 50 to 65 Shore D. The TEXIN 250 thermoplastic polyurethane has a Shore D hardness of approximately 56. The TEXIN 255 thermoplastic polyurethane has a Shore D hardness of approximately 65. The IROGRAN 433.63 thermoplastic polyurethane has a Shore D hardness of approximately 60. The HYLENE thermoplastic polyurethane has a Shore D hardness of approximately 55.

The thickness of the insert 60 may vary depending on its application. A preferred thickness for a putter 50 is in the range of 0.125 to 0.500 inch. A preferred range of thickness is 0.188 inch to 0.200 inch. A preferred thickness is 0.198 inch. The thickness of the insert 60 is increased or decreased to influence the feel to the golfer during impact with a golf ball.

The inserts 60 may be coated with a protective coating such as a lacquer, a clear coat, or a paint to enhance the color of the insert. Further, an indicia may be placed on the insert using pad printing or other printing techniques.

We claim as our invention:

1. A golf club head comprising:

a club head body having a front face with a recess therein;

an insert disposed within the recess, the insert comprising a body with an exterior surface, an interior surface and a perimeter defining the thickness of the body, the perimeter having a plurality of integral tabs extending therefrom that engage the club head body, the insert composed of a thermoplastic polyurethane material;

wherein each of the plurality of tabs is compressible, and each of the plurality of tabs has a straight portion and a curved portion, the straight portion disposed between the curved portion and the perimeter, and the curved portion extending further than the straight portion to define an undercut between the curved portion and the perimeter.

2. The golf club head according to claim 1 wherein each of the plurality of tabs is disposed a predetermined distance apart from each other and the golf club head further comprises an epoxy disposed between each of the plurality of tabs.

3. The golf club head according to claim 1 further comprising means for attaching the insert within the recess of the body.

4. The golf club head according to claim 3 wherein the attachment means is an epoxy adhesive applied to the interior surface of the insert.

5. The putter-type golf club head according to claim 1 wherein the thermoplastic polyurethane material is a selected from the group consisting of 4,4'-diphenylmethane diisocyanate-polyester thermoplastic polyurethanes and a paraphenylene diisocyanate-polyether thermoplastic polyurethane.

6. The golf head according to claim 1 further comprising a protective coating on the exterior surface of the insert.

7. The golf club head according to claim 1 wherein the thickness of the insert is between 0.125 and 0.5 inches.

8. The golf club head according to claim 1 wherein the insert is between 10 to 25 percent of the volume of the club head.

9. The golf club head according to claim 1 wherein the insert is between 1 to 5 percent of the weight of the club head.

10. The golf club head according to claim 1 wherein the insert is between 55 to 75 percent of the area of the face of the club head.

* * * * *

UNITED STATES PATENT AND TRADEMARK OFFICE

CERTIFICATE OF CORRECTION

PATENT NO. : 6,893,358 B2
DATED : May 17, 2005
INVENTOR(S) : Dewanjee et al.

It is certified that error appears in the above-identified patent and that said Letters Patent is hereby corrected as shown below:

Title page,
Item [74], *Attorney, Agent, or Firm*, should be -- … Michael A. Catania; Elaine H. Lo --

Signed and Sealed this

Ninth Day of August, 2005

JON W. DUDAS
*Director of the United States Patent and Trademark Office*